United States Patent [19]

Maxon, III

[11] 4,441,820

[45] Apr. 10, 1984

[54] CONCRETE MIX SURGE BIN

[75] Inventor: Glenway W. Maxon, III, Bayside, Wis.

[73] Assignee: Maxon Industries, Inc., Milwaukee, Wis.

[21] Appl. No.: 423,784

[22] Filed: Sep. 27, 1982

[51] Int. Cl.[3] ..... B01F 7/04

[52] U.S. Cl. ..... 366/26; 366/46; 366/185; 366/196

[58] Field of Search ..... 68/210; 366/26, 42, 366/44, 45, 46, 47, 50, 51, 52, 53, 56, 61, 62, 185, 186, 192, 193, 194, 195, 196, 250, 603; 414/420

[56] References Cited

U.S. PATENT DOCUMENTS

| | | | |
|---|---|---|---|
| 2,465,899 | 3/1949 | Maxon, Jr. | 298/17 R |
| 2,613,106 | 10/1952 | Maxon, Jr. | 298/17 R |
| 2,618,472 | 11/1952 | Castendyck | 366/44 |
| 2,674,489 | 4/1954 | Maxon, Jr. | 298/17 R |
| 3,220,584 | 11/1965 | Swanson | 414/420 |
| 3,612,491 | 10/1971 | Mckillop | 366/59 |
| 3,792,838 | 2/1974 | Jacopini et al. | 366/45 |
| 3,866,889 | 2/1975 | Maxon | 366/68 |
| 3,901,485 | 8/1975 | Schwing | 366/59 |

*Primary Examiner*—Robert W. Jenkins
*Assistant Examiner*—Arthur D. Dahlberg
*Attorney, Agent, or Firm*—James E. Nilles; James R. Custin

[57] ABSTRACT

A surge bin for concrete mix comprises an open-topped body having side walls with rear portions that converge towards a gated rear discharge outlet and having a bottom wall curved concentrically to an agitator axis that extends fore-and-aft in the body. A horizontal frame underlies the body. Front and rear lifting actuators connected between the frame and the body move the body between a charging position in which the bottom wall is near the frame and a discharging position in which the body is above and to the rear of its charging position. The side walls are of such height that conventional dump trucks can discharge over them with the body in charging position. An agitator in the body rotates concentrically to said axis, in one direction to move material out of the outlet, in the opposite direction for remixing.

6 Claims, 6 Drawing Figures

CONCRETE MIX SURGE BIN

FIELD OF THE INVENTION

This invention relates to an improved surge bin that is particularly suitable for temporary storage of wet plastic concrete mix hauled from a central batching plant to a placement site, and the invention is more particularly concerned with a holding vessel into which transport vehicles can quickly dump plastic concrete mix and from which the mix can be discharged as and when needed.

Although the surge bin of this invention is particularly intended for use with plastic concrete mixes and has special advantages for use with such mixes, it is also suitable for temporary storage of dry concrete mix, aggregate mixes, asphalt mix, grain and other materials.

BACKGROUND OF THE INVENTION

When wet plastic concrete mix is to be emplaced at a job site that is at some distance from a plant where the material is batched or mixed, optimum utilization of vehicles is obtained when each can quickly discharge its load and then promptly start back to the batching plant for another load. It has been recognized that such fast turn-around of the transport vehicle can be achieved if a satisfactory surge bin is located at or near the job site, into which the vehicles can dump their loads and which can in turn discharge the mix, as and when needed, into wheelbarrows, a crane bucket, a concrete pump, a paving machine or other placement means. Without a surge bin, each transport vehicle has to spend a long period at the site, discharging its load little by little into the placement means; and to maintain constant availability of mix at the job site there has to be another loaded vehicle standing by while the preceding one finishes delivering its load. With a surge bin, fewer transport vehicles are needed for placing a given amount of concrete in a given time, because each vehicle spends most of its time in the actual transportation of mix, and the surge bin—as the name implies—absorbs the surges in delivery and ensures a constant supply of mix at the job site.

Several surge bins for wet plastic concrete mix have appeared on the market from time to time, but no such prior surge bin has been completely satisfactory.

Perhaps the least expensive and least complicated concrete mix surge bin heretofore available comprises a sturdy frame which normally rests on the ground but which has retractable wheels on which the unit can be towed. Tiltably mounted on the frame is a body that has an open-topped front portion and has top, bottom and side walls at its rear portion that converge rearwardly towards a gated discharge outlet in its rear end. In a lowered position of the body, its top is low enough to permit a conventional dump truck to discharge over its front wall into its open-topped front portion. For discharge of the surge bin a hydraulic actuator lifts the front end of its body, swinging the body up about a horizontal, laterally extending axis near its rear end that is at a high enough level to allow a crane bucket or a concrete pump hopper to be located beneath the discharge outlet. A serious disadvantage of this surge bin is that it has no provision for remixing. High slump (thin consistency) concrete mix tends to segregate during transport to the surge bin, and mere discharge into the surge bin does not satisfactorily remix it High slump concrete also tends to segregate in the surge bin if held for any substantial time without remixing. Low slump concrete if held without remixing, tends to set up rather quickly and to be discharged in clumps. In this prior surge bin, problems due to the lack of a remixing agitator are reduced to some extent by small capacity, which is not much greater than that of a transport vehicle. However, the combined disadvantages of low capacity and lack of an agitator severely limit its utility, and this prior surge bin appears to have had correspondingly limited sales notwithstanding its low cost.

U.S. Pat. No. 3,612,491, issued to R. W. McKillop et al in 1971, discloses a remixing surge bin which avoids some of the disadvantages of the device just described, but has other significant disadvantages, including substantially higher cost. The patent discloses an axially elongated mixing drum rotatably mounted on a trailer chassis with its axis extending lengthwise of the chassis and inclined forwardly and downwardly. The front end of the drum is closed. At its higher rear end the drum has a large concentric opening through which it is charged and through which it also discharges. A funnel-like charging hopper directly behind the drum has a downwardly and forwardly inclined spout that extends into the drum through the opening and terminates inside the drum at about the level of the drum axis. Beneath the open rear end of the drum is a downwardly and rearwardly inclined delivery chute into which mix issues by spilling over the lip of the drum opening, driven out of the drum by a spiral blade therein that moves the mix rearward when the drum rotates in one direction. When the drum rotates in the opposite direction, the blade draws mix away from the charging hopper and drives it towards the closed front end of the drum for remixing. Since the charging hopper is at a high level, and is necessarily rather small, transport vehicles discharge their loads onto a belt conveyor which has its receiving end in front of the unit, at a low level, and which carries the material upwardly and rearwardly over the drum, discharging into the hopper. To avoid spillage, concrete mix must be discharged onto the conveyor rather slowly, and the need for such gradual unloading of transport vehicles is an undesirable requirement in a surge bin, especially since reduction of transport vehicle turn-around time is a major reason for use of a surge bin. The surge bin of McKillop et al has the further disadvantage that the mix inside the drum is not readily visible, and therefore it is inconvenient and time consuming to determine how much material is in the drum and whether or not the mix needs additional water. Another serious disadvantage is that cleaning out the drum may be difficult and very unpleasant if a person has to work inside it to chip away hardened concrete.

A prior surge bin invented by the present applicant is disclosed in U.S. Pat. No. 3,866,889. It is an adaptation of a previously devised open-topped agitating dump body already on the market, mounted on a truck chassis so that it can be used for transporting concrete mix (or other material) when not needed as a surge bin. The bottom wall of the body slopes upwardly and rearwardly to a gated discharge outlet, and the body is tiltable about a transversely extending horizontal axis that is near the discharge outlet and hence at a high level. Mix is charged into the body from a belt conveyor which has its receiving end in front of the truck at a low level and which extends upwardly and rearwardly over the truck cab to deliver into the front of the body. Inside the body is an agitator that remixes the material and/or moves it rearward towards the discharge outlet, where the gate meters outflow from the body. Concrete mix discharged from the body is distributed by a chute or conveyor that extends rearwardly from the truck chassis and onto which the body discharges. As compared with the McKillop et al device, this surge bin has the obvious advantages of being lower in cost and of having an open-topped body in which concrete mix is directly visible and which is much easier to clean than a drum. However, because it also comprises a belt conveyor, it has the same disadvantage of tying up a transport vehicle during the slow and gradual unloading that is necessary to prevent spillage at the conveyor. Furthermore, in its preferred form comprising a truck chassis, the capacity of this surge bin is limited to one truck load. Considered apart from its capability for transport use, it must be regarded as relatively expensive for a surge bin of such small capacity.

Another concrete mix surge bin that has been commercialized but has not received unqualified approval is disclosed in U.S. Pat. No. 3,901,485, to F. W. Schwing. It comprises a mixing drum resembling that of McKillop et al in being axially elongated and mounted on a trailer chassis, but the Schwing mixing drum has a gated concentric outlet at its front end in addition to a concentric inlet opening at its rear end. The axis of the Schwing drum is inclined oppositely to that of McKillop et al; that is, the axis of Schwing's drum slants upward and forward towards the discharge outlet, which is at the small end of a long, forwardly tapering frustoconical portion of the drum. Behind the drum and closely adjacent to it is a charging hopper which has its upper edge at a low enough level for transport vehicles to discharge directly into it. A spiral blade in the drum draws mix forwardly away from the charging hopper and up along the drum, for remixing or for driving the material out of the discharge outlet when its gate is open. Because the drum outlet is at a relatively high level, it can discharge directly into the feed hopper of a concrete pump or into a crane bucket. However, the charging hopper at the rear of the drum has a relatively small capacity, and mix is drawn out of it relatively slowly by the spiral blade in the drum so that the Schwing surge bin, like the others described above, compels a relatively slow unloading of each transport vehicle. Furthermore, as with the McKillop et al surge bin, the quantity and consistency of the material inside the drum is hard to see, and cleaning out the drum is difficult and time consuming.

It will be apparent that a satisfactory surge bin for wet plastic concrete mix poses several requirements which have not heretofore been satisfactorily reconciled. A very important requirement is that it be capable of receiving mix from a transport vehicle as quickly as the vehicle can dump, to ensure fast turn-around of the vehicle. A dump truck can discharge wet plastic concrete mix at rates as high as about one cubic yard per second, whereas a conventional belt conveyor can accept such concrete mix at rates no higher than about one cubic yard in 20 seconds. Hence, a conventional belt conveyor is obviously an unsatisfactory expedient for charging a surge bin. A further and complicating requirement is that the surge bin should have its outlet at a high level for discharge, so that it can feed directly into a placement means such as a wheelbarrow, a crane bucket, or the hopper of a concrete pump; but the surge bin should nevertheless be adapted to be loaded from a transport vehicle that has its discharge outlet at a low level.

Specialized dump bodies for transporting concrete mix were disclosed in U.S. Pat. Nos. 2,465,899, 2,613,106 and 2,674,489, all issued to G. Maxon Jr. Such bodies, which have had a substantial degree of commercial success, are arranged to have their outlets at a high level during discharge. Perhaps the need for a surge bin to discharge at a high level could be rather easily accommodated if the surge bin were arranged to take advantage of the high discharge feature of the dump bodies disclosed in these Maxon Jr. patents. However, the most desirable vehicle for carrying concrete mix from a mixing plant to a job site is an ordinary dump truck. Because it can be used for a wide variety of hauling jobs, a conventional dump truck can find almost constant employment, and therefore its fixed costs (license fees, insurance, etc.) can be much lower per hour of operation than those of a vehicle specialized for transporting concrete mix.

It follows that a satisfactory surge bin for wet plastic concrete mix should be arranged to be charged from a conventional dump truck. Obviously, if it can be loaded from such a truck it can also be loaded from any vehicle intended for specialized transport of concrete mix, such as a truck mixer or a truck with an agitating dump body.

If the surge bin is to be loaded from conventional dump trucks, provision for remixing in the surge bin is practically mandatory, and experience has shown that such provision is highly desirable even when the surge bin is loaded exclusively from truck mixers or agitating dump body trucks. The surge bin agitator should preferably assist in the metered discharge of mix from the surge bin; and when operating it should not interfere with charging of mix into the bin. It should be effective to agitate all of the material in the surge bin.

Another desideratum of a satisfactory surge bin is that its body have an open top, rather than being a rotatable drum. Transport vehicles can dump directly into an open-top body, making possible the quick turnaround that is a principal objective for use of a surge bin. Concrete mix in such a body is visible at all times, so that the quantity and the consistency of the material can be readily ascertained and water, as needed, can be added quickly and easily. An especially important advantage of a surge bin body that is open at its top is that it is much easier to clean than a drum.

High capacity, simplicity, extreme sturdiness and low cost are further requirements for a satisfactory surge bin that must be reconciled with one another and with the other requirements set forth hereinabove.

SUMMARY OF THE INVENTION

The general object of the present invention is to provide a surge bin that is especially suitable for wet plastic concrete mix and very satisfactorily meets all of the requirements set forth above.

In particular, it is an object of the invention to provide a simple, sturdy and versatile surge bin into which wet concrete mix can be charged from conventional dump trucks that are unloaded as quickly as they can dump, but which nevertheless discharges from a high level and at a controllably metered rate, and wherein there is a remixing agitator that can continue to operate while charging of the bin takes place, is effective on all portions of the mix in the bin, and assists in controlled discharge from the bin.

A more specific object of the invention is to provide a high capacity surge bin which is so arranged that two conventional dump trucks or other mix transporting vehicles can dump into it substantially simultaneously, from opposite sides of it, to avoid traffic conflicts between vehicles and reduce their turn-around times to substantially an absolute minimum.

It is also an object of the invention to provide a remixing surge bin that has an open top, so that contents are always visible for checking as to quantity and quality and cleaning is fast and easy.

Another specific object of the invention, and a very important one, is to provide a surge bin of the character described which is so arranged that its rear discharge outlet moves up from a lowered loading position to an elevated discharging position with an initial forward component of motion and a subsequent substantial rearward component, so that the discharge outlet is first carried forwardly away from a placement means (wheelbarrow, crane bucket, etc.) into which it is to discharge but then continues moving up to an elevated discharging position in which it is directly over the placement means.

These and other objects of the invention which will appear as the description proceeds are attained by the surge bin of this invention which comprises, in general, a body that is open at its top and has a bottom wall which, at substantially all points along its length, is curved concentrically to a substantially horizontal agitator axis that extends through the body from front to rear thereof. The body has a pair of side walls that are spaced to opposite sides of said axis, at least the rear portions of said side walls being convergent towards a gated discharge outlet at a rear end of the body and the upper edges of said side walls being at such a height above said bottom wall that with the latter near grade a conventional dump truck can discharge into the body over each side wall. An agitator in the body has a shaft rotatable concentrically to said axis in at least one direction, a plurality of arms extending substantially radially from the shaft at intervals along its length, and a blade on the radially outermost end of each arm that sweeps closely adjacent to the bottom wall and is so inclined to said axis as to propel material in the body towards the discharge outlet upon rotation of the shaft in said one direction. A substantially horizontal frame underlies the body, and front and rear lifting means are connected between the body and said frame, at a front portion of the body and at a rear portion thereof, respectively. The lifting means are arranged for moving the body substantially vertically between a lowered charging position in which said bottom wall is near grade and an elevated discharging position at which material discharged from the outlet can fall directly into placement means.

In a preferred embodiment of the invention, at least one of the lifting means comprises an elongated lever having at one of its ends a fulcrum connection to said frame and having at its other end a pivotal connection to said body which, in the charging position of the body, is at a lower level than said fulcrum connection and is spaced a substantial distance forwardly therefrom, so that as said lever is swung up about the fulcrum connection the body first rises with a component of forward motion and thereafter continues to rise with a component of rearward motion such that its discharging position is to the rear of its charging position.

BRIEF DESCRIPTION OF DRAWINGS

In the accompanying drawings, which depict what are now regarded as preferred embodiments of the invention.

DETAILED DESCRIPTION OF PREFERRED EMBODIMENTS OF THE INVENTION

Figure 1:
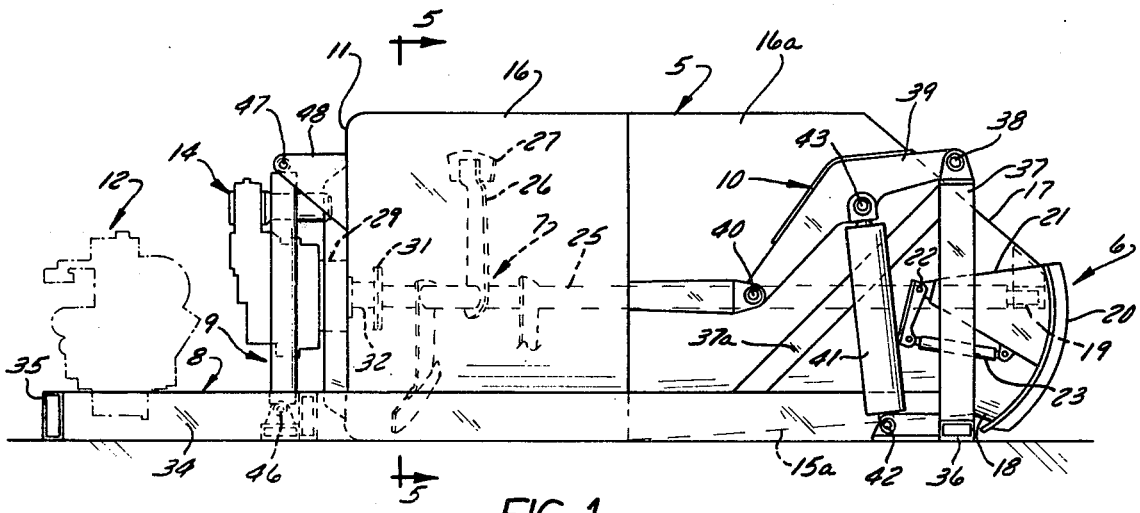
FIG. 1 is a view in side elevation of a surge bin embodying the principles of this invention, shown in its lowered charging position.

A surge bin that embodies the principles of this invention comprises, in general, an open-topped body 5 that has a gated discharge outlet 6 at a rear end thereof and in which there is an agitator 7 that rotates on an axis that extends fore-and-aft through the body. Underlying the body 5 is a sturdy horizontal frame 8. If the surge bin is intended for underground use, its frame 8 may be mounted on generally conventional rail trucks (not shown); and if it is intended for above-ground use the frame 8 will normally rest on grade. In either case, front and rear lifting means 9 and 10, respectively, are connected between the frame 8 and the body 5 to support the body on the frame and to move the body generally vertically between a low level charging position and an elevated discharging position. The frame 8 also supports an engine driven hydraulic pump 12 which is mounted in front of the body 5 and which provides pressure fluid for the lifting means 9 and 10 and for driving a hydraulic motor 14 that rotates the agitator 7.

Figure 5:
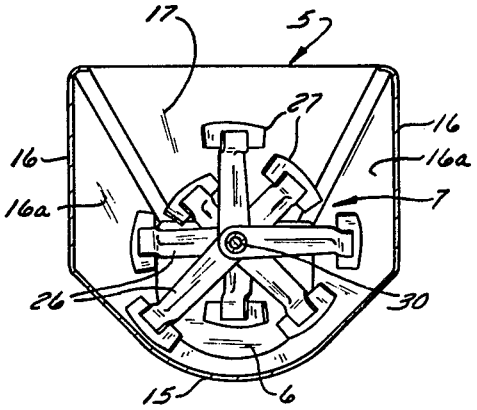
FIG. 5 is a view in cross-section of the surge bin body, taken on the plane of the line 5—5 in FIG. 1.
Figure 6:
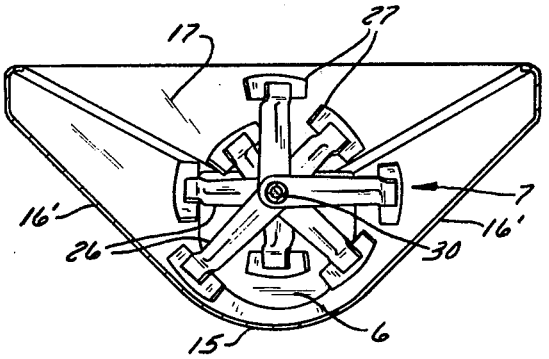
FIG. 6 is a view generally similar to FIG. 5 but illustrating a modified form of the body.

The body 5 has a bottom wall 15 which is closely adjacent to the frame 8 when the body is in its lowered charging position. At substantially every point along its length the bottom wall 15 is curved concentrically to the axis of the agitator 7, and it merges into side walls 16 that are spaced to opposite sides of said axis. If the surge bin is intended for underground use, where overall width is rather stringently limited, the side walls 16 will be substantially upright, as shown in FIG. 5. If the surge bin is intended for above-ground use, wherein a larger overall width is acceptable, the side walls 16' can be inclined laterally outwardly and upwardly, as shown in FIG. 6. A body having upright side walls as shown in FIG. 5 will have a somewhat smaller capacity than one with side walls as shown in FIG. 6; but for underground work, wherein the surge bin comprises a rail car, two or more surge bin rail cars of this invention can be coupled in tandem, to provide whatever surge bin capacity is needed. As explained hereinafter, such tandem coupling is feasible because each surge bin car can discharge directly into the one behind it.

In both of the illustrated embodiments, the top edges of the body side walls 16 are about four feet above the level of the lowest point on the bottom wall 15 of the body. With side walls of this height in a surge bin for above-ground use, a conventional dump truck can discharge into the body across either of its side walls when the body is in its lowered position. A rail car surge bin for underground use will usually be loaded from delivery trucks by spotting it at the bottom of a shaft or well through which the trucks dump down into it from grade level, but its side walls should not exceed a height of about four feet, so that it can also be loaded from a surge bin car ahead of it without requiring the latter to raise its body excessively. It will be observed that with the above-ground surge bin configuration shown in FIG. 6, two conventional dump trucks can discharge into the body 5 substantially simultaneously, one at each side of it, for minimum traffic delays at the job site.

The front wall 11 of the body 5 is preferably upright and has its upper edge coplanar with the top edges of the side walls 16.

At least the rear portions 16*a* of the side walls 16 are rearwardly convergent towards the discharge outlet 6. Through the portion of the body in which the side walls converge rearwardly, the bottom wall 15 is conical with a slight rearward taper, as at 15*a*, whereby that rear portion of the bottom wall has a slight upward and rearward inclination when the body is in its low level charging position. To prevent spillage when the body is discharging while substantially fully loaded, there is a top wall 17 on its rearmost portion that has a substantial downward and rearward inclination. It will be apparent that this top wall 17, the rear portions 16*a* of the side walls and the rear portion 15*a* of the bottom wall all converge funnel-fashion towards the discharge outlet 6.

The rearmost edge portion of the bottom wall 15 forms a downwardly and rearwardly inclined lip 18 at the outlet 6 that tends to prevent scattering of mix issuing from the outlet and confines it to a narrow, steady stream. The top wall 17 projects a little farther rearwardly than the bottom wall and at its underside supports a rear bearing 19 for the agitator 7. The side walls 16 have curved rear edges which extend from the rear edge of the top wall 17 to the rear edge of the bottom wall 15.

Figure 2:
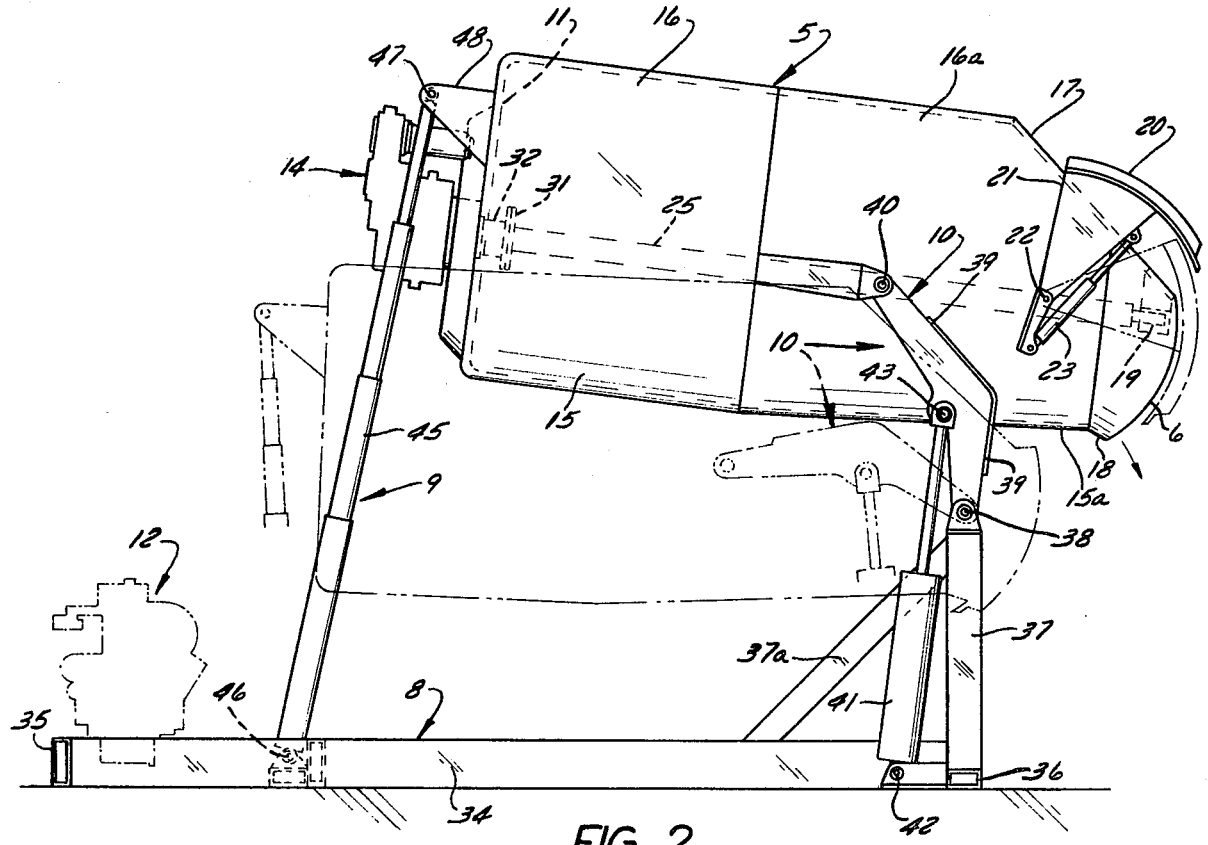
FIG. 2 is a view of the surge bin in side elevation, in its elevated discharging position.
Figure 3:
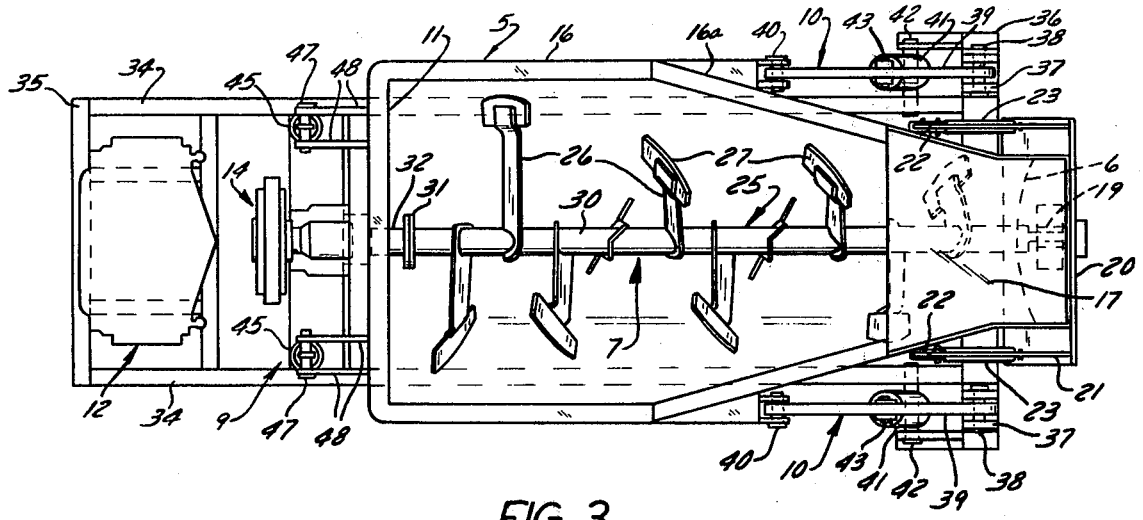
FIG. 3 is a top view of the surge bin.
Figure 4:
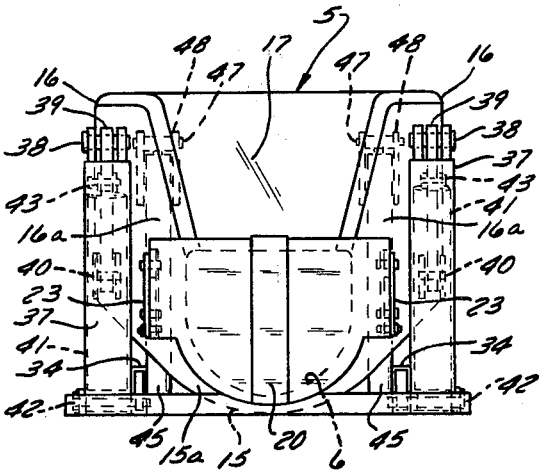
FIG. 4 is a view of the surge bin in rear elevation.

The outlet 6 is normally closed by a gate comprising a plate 20 that is curved to mate with the arcuate rear edges of the side walls and is swingable between a lowered or closed position (FIG. 1) and a raised fully open position in which it is shown in full lines in FIG. 2. For such swinging, the plate 20 is rigidly mounted on forwardly projecting arms 21 that have their front ends pivoted to the body, as at 22. The axis about which the plate 20 and the rear edges of the side walls are concentrically curved is located a small distance below the swinging axis defined by the gate pivots 22, and therefore the gate moves up and open with a small rearward component that carries it away from the edges of the body outlet, to minimize wear. A double-acting gate actuating cylinder 23 is connected between the body 5 and each of the gate arms 21 for raising and lowering the gate.

The agitator 7 comprises a shaft 25 that rotates concentrically to the axis about which the bottom wall 15 is curved. A plurality of rigid arms 26 project substantially radially from the shaft 25 at intervals along its length, and a blade 27 is mounted on the outer end of each arm with its surface inclined to the plane of the orbit of its arm. The several blades 27 are so arranged and disposed as to sweep at least a major portion of the area of the body bottom wall 15 and are so pitched that they cooperate to propel concrete mix rearward through the discharge outlet 6 in one direction of shaft rotation. Instead of the individual paddle-like blades 27, the arms 26 could cooperate in supporting a spiral blade (not shown) that extends partway or entirely along the length of the shaft 25; but the individual blades 27 are believed to produce a better remixing action. It will be apparent that if the speed of agitator rotation is controllable, the rate of discharge of mix from the body can be varied as desired while the gate 20 remains in a given open position; but it is also possible to control the discharge rate by adjusting the position of the gate 20 while the agitator 7 rotates at a fixed speed; or discharge can be controlled by a combination of adjustments of gate position and agitator speed.

Cooperating with the bearing 19 at the rear of the body to mount the agitator shaft 25 for rotation is a coaxial front bearing 29 that is mounted on the body front wall 11, preferably at its front side. The agitator shaft 25 preferably has a main section 30 in the body 5 which has its front end just behind the front body wall 11 and which has a detachable connection 31 with a short coaxial extension shaft 32 that projects through the front wall 11 and the front bearing 29, thus providing for ready removability of the agitator from the body. It will be understood that the shaft bearings 19 and 29 are provided with appropriate seals and that the front end portion of the extension shaft 32 projects beyond the front bearing 29 to have a driving connection with the hydraulic motor 14, which is also mounted on the body 5 at the front side of the front wall 11. The hydraulic motor 14, in addition to being controllable as to its speed, is preferably also reversible so that the agitator 7 can be driven oppositely to the above-mentioned direction of rotation for remixing. Remixing by propelling the material forwardly not only avoids imposition of a load upon the discharge gate 20 but also assures better mixing because, instead of congesting in the funnel-like rear portion of the body, the material piles up against the upright front wall 11 and then slumps away from it with a folding action.

The frame 8 can be rectangular in planform, comprising a pair of longitudinal side sills 34, front and rear transverse members 35 and 36, respectively, and other transverse bracing members (not shown) connected between the sills 34 at suitable locations.

At the rear end of each longitudinal sill 34 is a sturdy upright post 37, preferably braced by a diagonal strut 37*a* that extends from its top end forwardly and downwardly to its sill. Pivoted as at 38 to the top of each post 37 is a fulcrum end of a sturdy lever 39 that extends generally forwardly from the post and has its front end pivotally connected, as at 40, to the body 5. For each of the levers 39 there is a double-acting hydraulic cylinder 41 that has a lower end pivotally connected, as at 42, to the frame 8 and has an upper end pivotally connected, as at 43, to the lever 39 intermediate the ends thereof. The levers 39, in cooperation with their respective hydraulic cylinders 41, comprise the rear body lifting means 10.

The axes of the several pivots 38, 40, 42 and 43 of the rear lifting means 10 are all horizontal and oriented transversely to the agitator axis. Furthermore, when the body 5 is in its lowered charging position, the pivot connection 40 between the body and the front end of each lever 39 is at a lower level than the fulcrum pivot 38 at the rear end of the lever. Consequently, as the hydraulic cylinders 41 extend, the swinging of the levers 39 about their fulcrums 38 carries the body upwardly in an arc whereby it initially rises with a forward component of motion that carries its outlet away from adjacent placement means; and after the body connection 40 passes the level of the fulcrum 38, the body continues its rise with a substantial component of rearward motion that brings it to a fully raised position in which the outlet 7 is directly over the placement means for discharge straight down into it. Because of this scheme of body motion, the placement means can be substantially permanently located just behind the surge bin, as is necessary in the case where the placement means comprises the hopper of a concrete pump. It will also be apparent that the substantial rearward motion of the body as it rises enables the front one of a pair of fore-and-aft adjacent surge bins of this invention to discharge directly into the one behind it. In the embodiment of the invention here shown, the levers 39 swing through a balance point, especially if a load in the body is concentrated near its discharge outlet, and therefore double-acting cylinders 41 are preferred for the rear lifting means.

The front lifting means 9 can comprise, at each side of the body 5, a long-stroke telescoping single-acting hydraulic cylinder 45 that has at its lower end a pivotal connection 46 to the frame 8 and has its upper end pivotally connected, as at 47, to short sturdy brackets 48 that are fixed to the body front wall 11 and project forwardly from it near its top. The need for a telescoping cylinder could be avoided by a known arrangement of the front lifting means 9, comprising for example a scissors linkage in cooperation with a conventional single-piston hydraulic cylinder; but it is believed that such more complicated lifting means structure would cost more than the preferred telescoping cylinder. It will be apparent that fore-and-aft control of the body through the range of its elevated positions is afforded by the levers 39 in their connections to the fixed posts 37.

Preferably the front lifting means 9 is operable independently of the rear lifting means 10, so that the body can be tilted to an attitude in which its front end is substantially higher than its discharge outlet, to facilitate clean-out or for rapid discharge, or to an attitude in which its rear end is elevated for continuous discharge (e.g., into a concrete pump hopper) and its front end is low to receive concrete from transport vehicles as they arrive. Such independent control can be effected in a known manner, as by providing one pump and control valve for the rear lifting means 10 and a separate pump and control valve for the front lifting means 9.

It will be understood that the body is for the most part shell-like, but that it has suitable frame-like reinforcing structure on its front wall 11 for support of the front shaft bearing 29, the hydraulic agitator motor 14 and the brackets 48. The side walls 16, particularly at their rear end portions, likewise have suitable reinforcing structure that transfers forces between the body and the rear lifting means 10 and supports the forces incident to raising and lowering the gate 20.

From the foregoing description taken with the accompanying drawings it will be apparent that this invention provides a surge bin particularly suitable for wet plastic concrete mix that can be loaded quickly from a conventional dump truck, is easily cleaned, and includes provision for effective remixing and for controlled discharge from a substantially high level.

What is claimed as the invention is:

1. A surge bin for temporary storage of material such as concrete mix, into which a dump truck can charge material and from which the material can be intermittently discharged, said surge bin comprising a body having opposite side walls that converge towards a discharge outlet at a rear end of the body and having an open top from its front end to near said discharge outlet, and an agitator in said body having an axis extending from front to rear thereof and rotatable in one direction about said axis to drive material in the body towards said discharge outlet, said surge bin being characterized by:

A. a substantially horizontal frame underlying the body and by which the body is supported;

B. a pair of lifting means, one near the front end of the body and the other near the rear end of it, each said lifting means having
  (1) a lower pivotal connection with the frame, at a fixed location thereon, and
  (2) an upper pivotal connection with the body, said pivotal connections having sidewardly extending axes, and said lifting means providing for vertical motion of both ends of the body in unison and alternatively for vertical motion of each end of the body relative to the other whereby the body is tilted; and C. motion control means for controlling forward and rearward motion of the body,
  (1) having a connection with the frame at a fixed location thereon, and
  (2) having a pivotal connection with the body near one of its ends that defines a sidewardly extending axis about which the body can tilt.

2. The surge bin of claim 1 wherein said motion control means is so arranged that during unison upward movement of both ends of the body from a fully lowered to a fully raised position thereof the body initially moves forward through one distance and thereafter moves rearward through a greater distance.

3. The surge bin of claim 1, further characterized by:
(1) said motion control means comprising a lever having opposite ends,
(2) said connection of the motion control means with the frame being a fulcrum connection at one end of said lever that has a sidewardly extending axis which is spaced a substantial distance above the bottom of the frame,
(3) said pivotal connection of the motion control means with the body being at the other end of said lever, and
(4) the upper pivotal connection of the lifting means near said one end of the body comprising a pivotal connection between that lifting means and the medial portion of the lever.

4. A surge bin for temporary storage of material such as concrete mix, into which a dump truck can charge material and from which the material can be intermittently discharged, said surge bin comprising a body having opposite side walls that converge towards a discharge outlet at a rear end of the body and being open at its top from its front end to near said discharge outlet, and an agitator in said body having an axis extending from front to rear thereof and rotatable in one direction about said axis to drive material in the body towards said discharge outlet, said surge bin being characterized by:

A. a substantially horizontal frame underlying the body and by which the body is supported;

B. front extensible and retractable lifting means having
  (1) an upper pivotal connection with the body near the front end thereof and
  (2) a lower pivotal connection with the frame, said pivotal connections having laterally extending axes, C. a lever having front and rear ends, (1) having at its rear end a fulcrum connection with the frame whereby its front end is swingable up and down about a laterally extending axis that is fixed with respect to the frame and spaced a substantial distance above the bottom of it, and (2) having at its front end a pivotal connection with the body, near the rear end thereof, that provides a laterally extending tilting axis for the body; and D. rear extensible and retractable lifting means (1) having a lower pivotal connection to the frame and (2) having an upper pivotal connection to the lever intermediate the front and rear ends thereof.

5. A surge bin for temporary storage of wet plastic concrete mix, characterized by:

A. a body having front and rear ends and having an open top from its front end to near its rear end, said body comprising:

(1) a pair of opposite side walls that have rear portions which converge toward a discharge outlet at the rear end of the body, and (2) a bottom wall extending from one to the other of said side walls and curved substantially concentrically to a fore-and-aft agitator axis that is in the body between said side walls;

B. a rotary agitator in the body, concentric to said axis, having blade means whereby material in the body is propelled rearward by rotation in one direction;

C. a substantially horizontal frame underlying the body;

D. lifting means connected between the frame and the body, arranged for lifting and lowering the body while maintaining it in a substantially constant attitude to carry the body between a lowered charging position in which said bottom wall is substantially at the level of said frame and an elevated discharging position; and E. motion control means connected between the frame and the body for imparting a substantial component of rearward motion to the body during a final portion of its movement upwardly to its discharging position so that its discharging position is to the rear of its charging position.

6. The surge bin of claim 5, further characterized by:

(1) said motion control means comprising a lever having (a) a fulcrum connection to the frame and (b) a pivotal control connection to the body which, in the charging position of the body, is spaced forwardly a substantial distance from said fulcrum connection; and (2) said lifting means comprising (a) front lifting means having a lower pivotal connection with said frame and an upper pivotal connection with a front portion of said body, and (b) rear lifting means having a lower pivotal connection with said frame and having upper pivot means whereby it is connected with a rear portion of the body, so that unison operation of the front and rear lifting means effects raising and lowering of the body and their differential operation effects tilting of the body.

* * * * *